US005251674A

United States Patent [19]

Nakano

[11] Patent Number: 5,251,674

[45] Date of Patent: Oct. 12, 1993

[54] WEFT FEELER DEVICE OF LOOM

[75] Inventor: Akira Nakano, Ishikawa, Japan

[73] Assignee: Tsudakoma Kogyo Kabushiki Kaisha, Kanazawa, Japan

[21] Appl. No.: 731,327

[22] Filed: Jul. 17, 1991

[30] Foreign Application Priority Data

Jul. 18, 1990 [JP] Japan ..... 2-190110

[51] Int. Cl.[5] ..... G01N 21/89; D03D 51/34

[52] U.S. Cl. ..... 139/370.2; 250/561

[58] Field of Search ..... 139/370.2, 116.2, 370.1; 250/561, 571, 559

[56] References Cited

U.S. PATENT DOCUMENTS 4,398,570 8/1983 Suzuki et al. ..... 139/370.2
4,471,816 9/1984 Wada ..... 139/370.2
4,546,263 10/1985 Gotoh et al. ..... 139/370.2 X

FOREIGN PATENT DOCUMENTS 61-646 1/1986 Japan .
2-19550 1/1990 Japan .
2-26963 1/1990 Japan .
2-33356 2/1990 Japan .

*Primary Examiner*—Peter Nerbun
*Attorney, Agent, or Firm*—Oblon, Spivak, McClelland, Maier & Neustadt

[57] ABSTRACT

This invention relates to a weft feeler device for detecting a success or a failure of weft insertion in case that two wefts are to be inserted per one picking, wherein a plurality of photo-electrical sensors and the discriminating circuits corresponding to each of the sensors are provided, and all the discriminating circuits are connected with a gate circuit. Thereby, failure insertion of two wefts may be positively detected.

6 Claims, 4 Drawing Sheets

WEFT FEELER DEVICE OF LOOM

BACKGROUND OF THE INVENTION

This invention relates to a weft feeler device of a loom, particularly a weft feeler device of a loom capable of detecting a success or a failure of an insertion of the weft when so-called double wefts insertion is carried out in a jet loom.

In the jet loom, two wefts per one pick are inserted to enable its productivity to be substantially improved and this operating form is generally called a double wefts insertion process. In this operation, the wefts are inserted through one weft insertion nozzle or parallelly arranged two weft insertion nozzles which are concurrently operated (for example, refer to Japanese Patent Application Laid-Open No. Sho 61-646).

When such double wefts are inserted, it is necessary to make a special arrangement for a weft feeler for detecting a success or a failure of the two wefts insertion. That is, the weft feeler is required to make a positive sensing of both cases in which both inserted wefts are both failured to insert and only one of them is failured. The prior art weft feeler merely detects a presence or a non-presence of the weft and it may not perform the latter sensing operation. Because, in case of the weft feeler using a photo-electrical sensor, when the two wefts are overlapped to each other, it is almost impossible to detect that the wefts are two or only one weft is present even if the presence or non presence of the weft be sensed.

In view of the foregoing, it has been proposed as a weft sensing method adapted for the double wefts insertion, to make a positive delay in reaching times of the two wefts to be inserted or to retract one weft from a sensing region of a photo-electrical sensor so as to perform a respective and discrete checking of the two wefts one by one. (refer to Japanese Patent Application Laid-Open No. Hei 2-19550, 2-26963 and 2-33356, respectively).

For example, when the two wefts to be released from each separate weft measuring and storing devices are to be inserted, only a terminal end portion of one weft is delayed to reach a sensing region of the sensor in time from the other weft by using an auxiliary engaging pin, thereby the sensor can check at first a presence or a non-presence of the other weft. Then, the auxiliary engaging pin is operated to cause the delayed one weft to be inserted into a normal length and at the same time the weft already checked at first is mechanically pulled back by a suitable pulling-back mechanism or the like and retracted from the sensing region of the sensor, resulting in that only the delayed weft can be singularly checked. That is, since the sensor may separately check the inserted two wefts in a separated time interval, it is possible to make a positive detecting of the success or failure of the double wefts.

In accordance with the prior art described above, although it has an advantage that a photo-electrical sensor can be used as a former one, it has a disadvantage that the auxiliary pin for delaying a reaching time of one weft or an auxiliary mechanism member such as the pulling-back mechanism for retracting the other weft is required not only to cause an entire structure to be complicated but also the system not to be adaptable for a high-speed operation. In addition, the prior art has a problem that the inserted two wefts are frequently entangled to each other under an influence of twisting or the like, the weft insertion to the sensing region for the delayed weft or the pulling-back operation for the other weft is not smoothly carried out, so the operation is not positively performed.

DISCLOSURE OF THE INVENTION

In view of the above, it is an object of the present invention to provide a weft feeler device of a loom of which structure is simple and which can be adapted for a high-speed operation and make a positive sensing of a failure insertion of either of the two wefts or a failure insertion of two wefts.

According to the present invention, each of the photo-electrical sensors may project a light beam against inserted wefts, may generate an output signal independently to each other and then an independent discriminating signal is output through a discrimination circuit arranged for each of the photo-electrical sensors. In this case, the discriminating circuits may output discriminating signals in response to a setting value to be set at an intermediate level of each of optical amount levels when the photo-electrical sensors detect one weft and when they detect two wefts, so that each of the discriminating circuits may discriminate that both two wefts are normally inserted, or that the two wefts are not inserted normally, only the latter case it may output a discriminating signal.

In turn, the gate circuit may output a failure weft insertion signal only when all the discriminating signals indicate a non-presence of two wefts, but may not output a failure weft insertion signal as long as at least one photo electrical sensor detects the presence of two wefts. In this case, each of the photo-electrical sensors may project a light beam in respect to a weft along a running direction of the wefts at the same position from different directions, so that it does not happen that the two wefts are overlapped to each other at all photo-electrical sensors. Accordingly, irrespective of the fact that the two wefts are normally inserted together, it happens quite scarcely that a failure weft insertion signal is erroneously outputted. In turn, when the both wefts are not normally inserted and when only one weft is normally inserted, any of the photo-electrical sensors may not detect the two wefts and the gate circuit may output positively the failure weft insertion signal.

The photo-electrical sensors may be arranged at different positions along a weft running direction or may be arranged at the same positions. In the latter case, the light beams are projected from different crossing directions with respect to the direction of the weft running.

DETAILED DESCRIPTION OF THE INVENTION

Referring now to FIGS. 1 to 4, one preferred embodiment of the present invention will be described.

Figure 1:
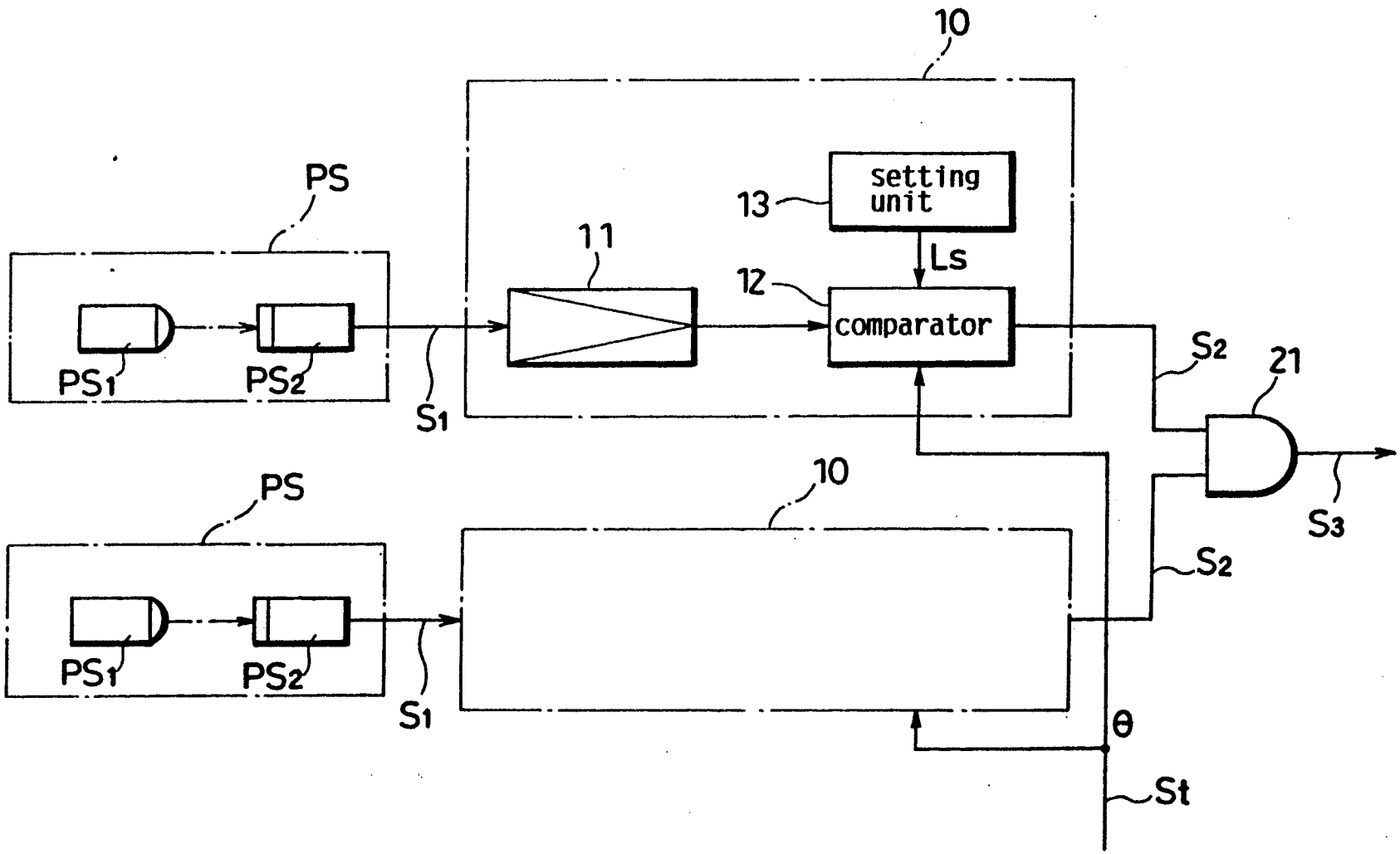
FIG. 1 is a schematic illustration for showing one preferred embodiment of the present invention.

As shown in FIG. 1, the weft feeler device of the loom is comprised of two sets of photo-electrical sensors PS, PS, discriminating circuits 10, 10 connected to each of the photo-electrical sensors PS, PS and AND gate 21 acting as a gate circuit.

Figure 2:
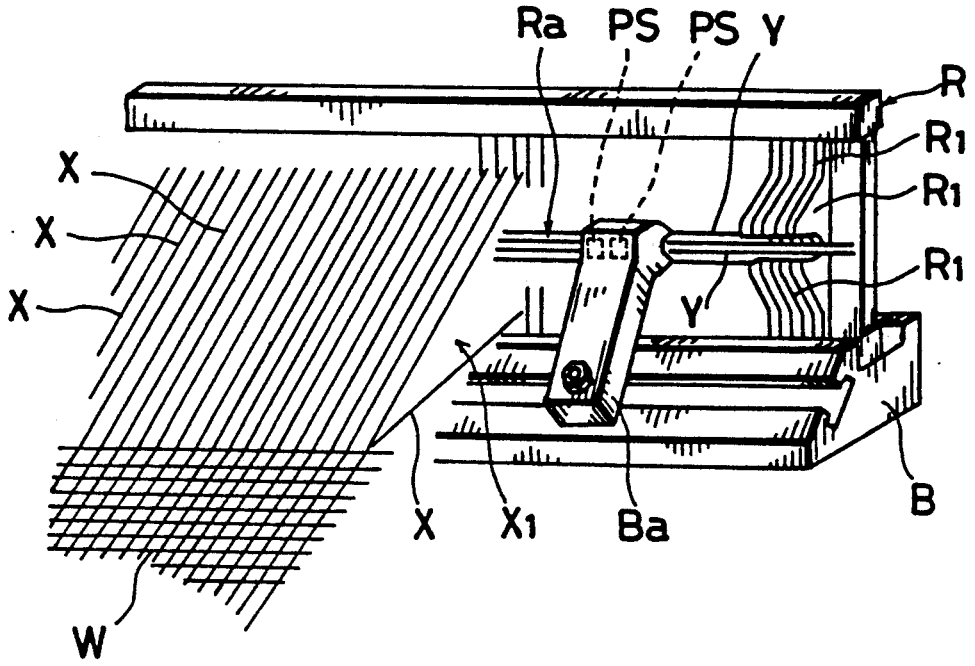
FIG. 2 is an illustration for showing a state of use of the preferred embodiment shown in FIG. 1.
Figure 3:
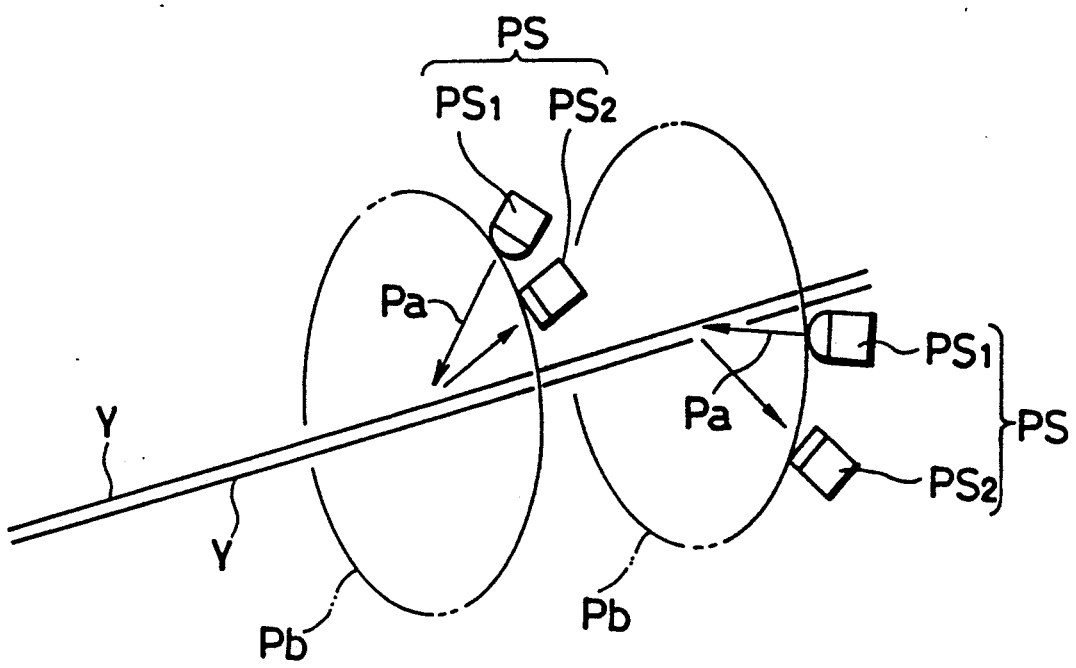
FIG. 3 is an illustration for showing mounted photo-electrical sensors of the preferred embodiment shown in FIG. 1.

The loom is of an air jet type or a water jet type as shown in FIG. 2, wherein the wefts Y, Y are concurrently inserted into an opening (a warp shed) X1 formed by the warps X, X through a single or two weft insertion nozzles arranged at a weft insertion side of the texture W. The wefts Y, Y run within a weft guide groove Ra formed in reed dents R1, R1 . . . of a reed block R mounted on a sley B.

As shown in FIG. 1, the photo-electrical sensors PS, PS are comprised of a reflection type sensor in which a light emitting unit PS1 and a light receiving unit PS2 are coupled to each other, respectively, and an output signal S1 from the light receiving unit PS2 is fed to a discriminating circuit 10.

The discriminating circuit 10 is comprised of a signal amplifier 11 for inputting the output signal from the light receiving unit PS2, a comparator 12 and a setting unit 13, wherein an output of the signal amplifier 11 is inputted to AND gate 21 as a discriminating signal S2 through the comparator 12. The setting unit 13 is connected to the comparator 12 and a timing signal St get from a timing signal generating means is also inputted to the comparator 12. The timing signal St is outputted from an encoder for use in sensing a rotational angle of a main shaft of the loom crank angle, it indicates a timing of a crank angle $\theta$ so as to detect the insertion of wefts Y, Y.

The photo-electrical sensors PS, PS are mounted on the sley B at the counter-weft insertion side of the texture W through a bracket Ba as shown in FIG. 2. The photo-electrical sensors PS, PS are arranged side-by-side along the weft guide groove Ra. Accordingly, the photo-electrical sensors PS, PS result to be arranged at different positions along the running direction of the wefts Y, Y (shown in FIG. 3). Each of the photo-electrical sensors PS is a reflection type sensor in which a light beam Pa is projected from the light emitting unit PS1 toward the wefts Y, Y and then it is reflected back by the wefts Y, Y and received by the light receiving unit PS2, wherein light beams Pa, Pa from the light emitting units PS1, PS1 are projected from a different direction in respect to the wefts Y, Y within imaginary planes Pb, Pb perpendicular to the wefts Y, Y.

Figure 4:
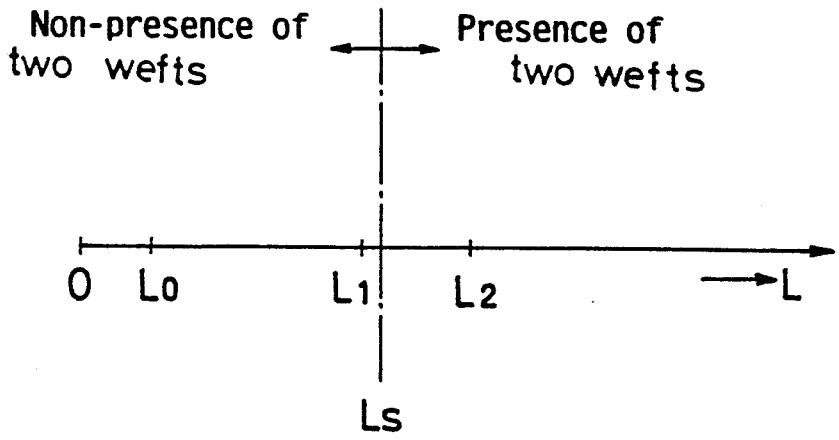
FIG. 4 is an illustration for showing an operation of the preferred embodiment shown in FIG. 1.

When the wefts Y, Y are set normally into a sensing region of each of the photo-electrical sensors PS, PS the light beams Pa, Pa from the light emitting units PS1, PS1 are reflected back by the wefts Y, Y and received by the light receiving units PS2, PS2. At this time, a level of quantity of light L at the light receiving units PS2, PS2 is normally at an intermediate level between a level of quantity of light L1 when one weft Y is present and a level of quantity of light L2 when two wefts Y, Y are not overlapped but arranged in parallel to each other, as shown in FIG. 4. Because, the wefts Y, Y are sometimes entangled with each other or mechanically severely vibrated, the reflected light to be incident to the light receiving unit may not indicate even if the two wefts Y, Y are normary reflected.

In case that the two wefts Y, Y are not present, a level of quantity of light Lo has a relation of $Lo<L1<L2$. It is assumed that the output signals S1, S1 from the light receiving units PS2, PS2 are also analogue signals which are proportional to a level of quantity of light L of the reflection light which is incident to the light receiving units PS2, PS2.

In turn, to the setting unit 13 of each of the discrimination circuits 10 is set an adequate setting value Ls corresponding to an intermediate level between a level of quantity of light L1 when the photo-electrical sensor PS detects one weft Y and a level of quantity of light L2 when the photo-electrical sensor PS detects two wefts Y, Y in this way. However, it is preferable that the setting value Ls is higher than the level of quantity of light L1 and near the level of quantity of light L1. Thus, the comparator 12 compares values of output signals S1 supplied through the signal amplifier 11, i.e. the level of quantity of light L of the reflection light which is incident to the light receiving unit PS2 and the setting value Ls to be set in the setting unit 13. When a relation of $L<Ls$ is present, it may output a discriminating signal S2 indicating non-presence of two wefts (refer to FIG. 4). That is, the discriminating signal S2 is outputted when the photo-electrical sensor PS does not detect the both wefts Y, Y or when the sensor detects only one weft Y, and the discriminating signal S2 is not outputted when the sensor detects presence of two wefts Y, Y.

AND gate 21 may output a failure weft insertion signal S3 when the discriminating signals S2, S2 are present together.

TABLE 1

| Output of failure weft insertion signal | | |
|---|---|---|
| Photo-electrical sensor PS (No. 1) | Photo-electrical sensor PS (No. 2) | A failure weft insertion signal from AND gate 21 |
| non-presence of two wefts | non-presence of two wefts | output |
| non-presence of two wefts | presence of two wefts | not output |
| presence of two wefts | non-presence of two wefts | not output |
| presence of two wefts | presence of two wefts | not output |

Accordingly, a case in which the failure weft insertion signal S3 is outputted corresponding to only the time when any of the photo-electrical sensors Ps, Ps do not detect the two wefts, and the failure weft insertion signal S3 is not outputted without this case.

That is, when the two wefts Y, Y are normally inserted, even in case that the two wefts Y, Y are seen as being overlapped to each other from one photo-electrical sensor PS, the two photo-electrical sensors PS, PS directed from a different direction in respect to the wefts Y, Y, the two wefts Y, Y can be detected at least by the other photo-electrical sensor PS and its corresponding discriminating circuit 10 does not output any discriminating signal S2, so that in this case, there is no possibility that the failure weft insertion signal S3 is erroneously outputted. In turn, in case that one weft Y is of a failure insertion, or in case that both two wefts Y, Y are failure insertion, both discriminating circuits 10 may output the discriminating signals S2 and S2. AND gate 21 may detect positively the signals S2, S2 and output the failure weft insertion signal S3, wherein the failure weft insertion signal S3 at this time can be guided to a loom control device (not shown) and then the loom can be stopped for its operation.

AND gate 21 may output the failure weft insertion signal S3 when the both discriminating signals S2, S2 are present through its positive logic. In place of this operation, in case that the discriminating signals S2, S2 indicate a presence of the two wefts, it is apparent that the logic may be converted into a gate circuit of a negative logic.

The photo-electrical sensors PS, PS may be constructed such that the light beams Pa, Pa are projected from the same direction within imaginary planes Pb, Pb against the wefts Y, Y. Although it happens frequently that the wefts Y, Y are entangled with each other in view of their types or a degree of twisting or the like, a sufficient spaced-apart arrangement of the photo-electrical sensors PS, PS enables the two wefts to be detectd substantially even if the light beams Pa, Pa are projected from the same direction as the above case. That is, even if one discriminating circuit 10 discriminates that the two overlapped wefts Y, Y are of one weft and outputs the discriminating signal S2, the other discriminating circuit 10 may discriminate that the two wefts Y, Y having less amount of overlapping are of two threads, resulting in that the discriminating signal S2 is not outputted.

OTHER PREFERRED EMBODIMENTS

Figure 5:
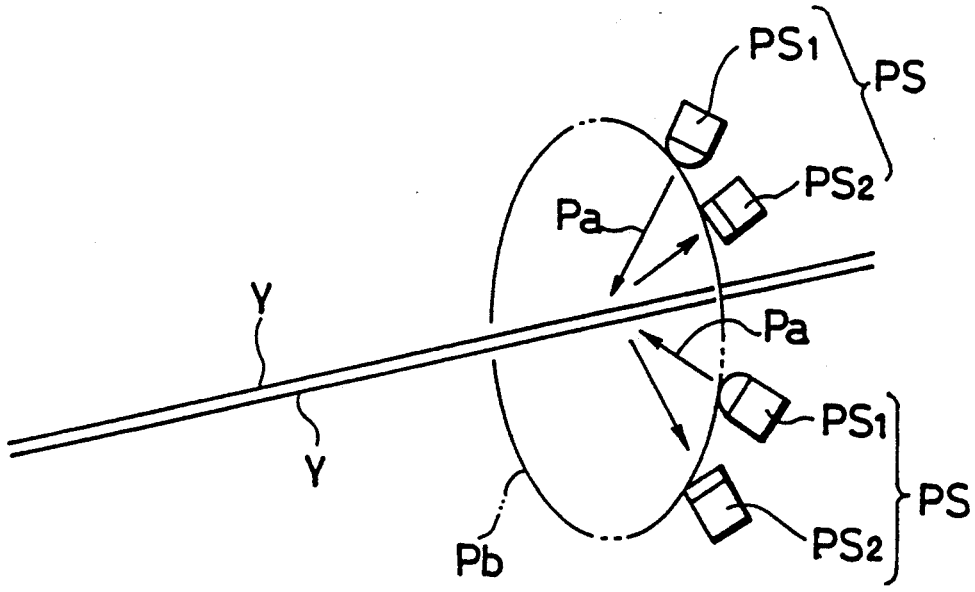
FIGS. 5 and 6 are illustrations for showing a state of use of another preferred embodiment of the present invention.
Figure 6:
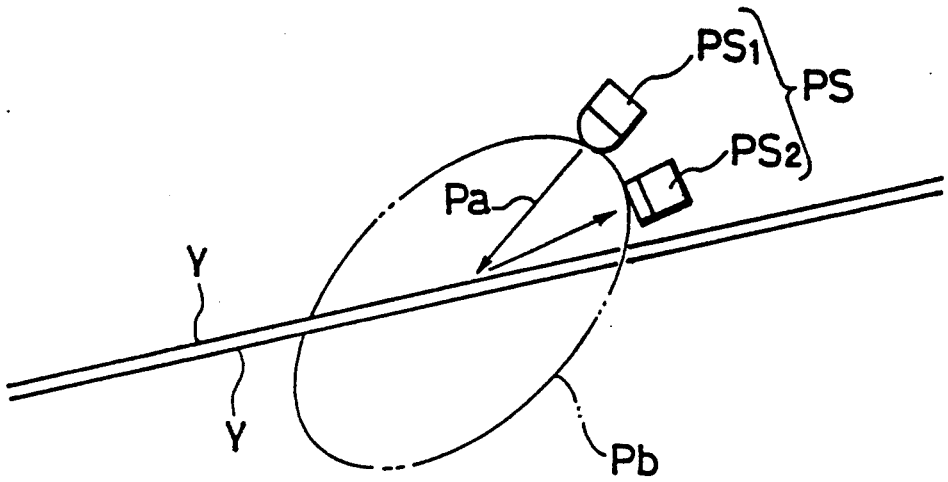

As shown in FIG. 5, the photo-electrical sensors Ps, Ps are arranged at the same positions along the running directions of the wefts Y, Y and they may be arranged such that the light beams Pa, Pa are projected from a different direction around the wefts Y, Y. That is, since the photo-electrical sensors Ps, Ps may see the wefts Y, Y from a different direction in respect to the wefts Y, Y, they may be operated in the same manner as that of the aforesaid preferred embodiment. In addition, in case of the arrangement having the light emitting unit PS1 and the light receiving unit PS2, an imaginary plane Pb formed by these elements may be inclined with respect to the wefts Y, Y as shown in FIG. 6.

Figure 7:
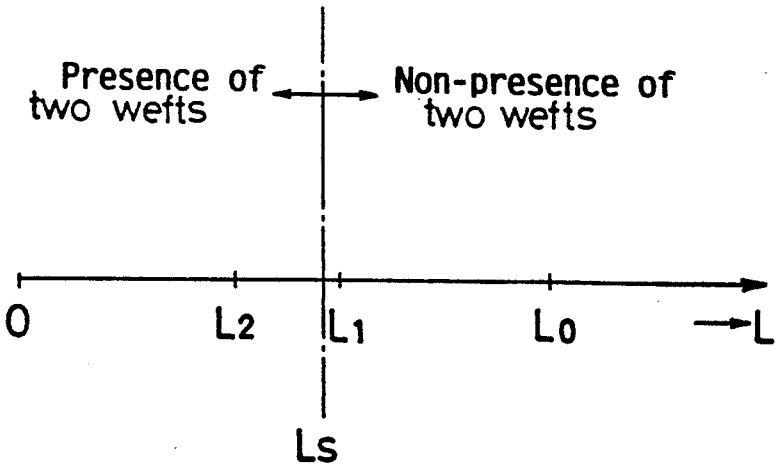
FIG. 7 is an illustration for showing an operation of a preferred embodiment using a transmittance type sensor.

The photo-electrical sensor PS may be of a transmittance type sensor in which a component of passing through the wefts Y, Y of the light beams Pa projected from the light emitting unit PS1 to the wefts Y, Y is got to the light receiving unit PS2. As shown in FIG. 7, at this time, the level of quantity of light L which is incident to the light receiving unit PS2 has a relation of $Lo>L1>L2$, so that the setting value Ls set in the setting unit 13 has a relation of $L2<Ls<L1$, and the comparator 12 may discriminate nonpresence of two wefts under a relation of $L>Ls$ and may output the discriminating signal S2.

The photo-electrical sensors Ps, Ps may be constructed such that a plurality of more than two sensors are applied and the discriminating circuit 10 can be connected to each of them. Each of the photo-electrical sensors Ps, Ps may detect the two wefts Y, Y at their different positions and even at the same positions (different directions), the sensors can detect the wefts from a different direction and/or position, so that an increasing of the number of the sensors may eliminate a possibility that the failure weft insertion signal S3 is erroneously outputted through the fact that the two wefts Y, Y are seen as an overlapped one thread irrespective of a normal insertion of the wefts Y, Y together. In addition, more than two discriminating signals S2, S2 . . . from more than two discriminating circuits 10, 10 . . . may be inputted in all to the same gate circuit as AND gate 21.

As described above, according to the present invention, there are provided a plurality of photo-electrical sensors, the discriminating circuits connected to each of the photo-electrical sensors and the gate circuit for outputting a failure weft insertion signal when any of the discriminating signals from each of the discriminating circuits may not indicate that there are two wefts, resulting in that the present invention may provide some effects that an auxiliary mechanism member such as an auxiliary engaging pin or a pulling-back mechanism or the like may not be required, the structure is remarkably simplified, a high-speed operation can be sufficiently adapted, and a proper setting of the setting value in the discriminating circuit may provide a positive sensing of the failure insertion weft in case that one of the two wefts is failure inserted.

What is claimed is:

1. A weft feeler device for detecting a success or a failure of an insertion of two wefts in a loom while weaving two wefts per one picking, the device comprising:

a plurality of photo-electrical sensors for sensing inserted wefts at a separate position respectively and providing a signal corresponding to the number of detected inserted wefts;

threshold setting means for setting an intermediate value between a first signal outputted from each of said photo-electrical sensors when one weft is detected and a second signal outputted from said photo-electrical sensor when two wefts are detected;

comparator means connected with each of said photo-electrical sensors and the threshold setting means for comparing the signals from each of said photo-electrical sensors with the intermediate value and then outputting discriminating signals when the signal from the photo-electrical sensors is less than the intermediate value; and a gate circuit connected with the output of the comparator means for outputting a failure weft insertion signal which represents a non-presence of the two wefts when the comparator means output the discriminating signals.

2. A weft feeler device of a loom according to claim 1 wherein said plurality of photo-electrical sensors are arranged at different positions along a running direction of the wefts.

3. A weft feeler device of a loom according to claim 1 wherein said plurality of photo-electrical sensors are arranged at different positions in a crossing direction in respect to a running direction of the wefts.

4. A weft feeler device of a loom according to claim 1 wherein said photo-electrical sensors are a reflecting type sensor comprising a light emitting unit and a light receiving unit.

5. A weft feeler device of a loom according to claim 1 wherein said photo-electrical sensors are a transmittance type sensor comprising a light emitting unit and a light receiving unit.

6. A weft feeler device of a loom according to claim 1, wherein said photo-electrical sensor is arranged so that a light beam of said photo-electrical sensor is inclined with respect to a running direction of wefts.

* * * * *